US006052547A

United States Patent [19]

Cuzzo et al.

[11] Patent Number: 6,052,547

[45] Date of Patent: Apr. 18, 2000

[54] METHOD AND APPARATUS FOR METERING PRINTER/COPIER USAGE

[75] Inventors: Clint S. Cuzzo, Star; W. K. Meade, II, Eagle, both of Id.

[73] Assignee: Hewlett-Packard Company, Palo Alto, Calif.

[21] Appl. No.: 09/178,444

[22] Filed: Oct. 23, 1998

[51] Int. Cl.[7] ..... G03G 21/02

[52] U.S. Cl. ..... 399/79; 377/8; 399/24; 399/27

[58] Field of Search ..... 399/24–27, 79, 399/8; 377/8, 13, 14, 26, 28, 30

[56] References Cited

U.S. PATENT DOCUMENTS

| | | | |
|---|---|---|---|
| 3,872,282 | 3/1975 | Long | 377/38 |
| 3,971,919 | 7/1976 | Fantozzi | 377/8 |
| 3,974,363 | 8/1976 | Malinich | 377/8 |
| 3,989,930 | 11/1976 | Sohm | 377/8 |
| 4,019,028 | 4/1977 | Polyzoes | 377/8 |
| 4,163,897 | 8/1979 | Hubbard et al. | 377/8 |
| 4,229,100 | 10/1980 | Travis | 355/77 |
| 4,707,748 | 11/1987 | Ohtsuka et al. | 358/298 |
| 5,117,258 | 5/1992 | Iwata | 399/79 |
| 5,160,966 | 11/1992 | Shiina et al. | 399/27 |
| 5,272,503 | 12/1993 | LeSueur et al. | 399/25 |
| 5,383,129 | 1/1995 | Farrell | 364/464.01 |
| 5,572,292 | 11/1996 | Chatani et al. | 399/25 |
| 5,754,916 | 5/1998 | Kitayama et al. | 399/27 |
| 5,771,420 | 6/1998 | Suzuki et al. | 399/25 |
| 5,850,584 | 12/1998 | Robinson et al. | 399/79 |
| 5,937,225 | 8/1999 | Samuels | 399/27 |

FOREIGN PATENT DOCUMENTS

| | | |
|---|---|---|
| 7-104622 | 4/1995 | Japan . |
| 9-138621 | 5/1997 | Japan . |
| 9-160452 | 6/1997 | Japan . |
| 9-247328 | 9/1997 | Japan . |

*Primary Examiner*—Matthew S. Smith

[57] ABSTRACT

The invention accurately meters usage of an electrophotographic printer/copier (EPC) by counting the number of pages that are ejected to an output bin of the EPC and incrementing a user charge value accordingly. Further, the invention determines a toner parameter value that is related to an amount of toner used on each page and bases the user charge value, at least in part, on such toner parameter value. The toner parameter value is preferably determined by counting a number of pixels that are imaged on a page. The invention further utilizes a non-volatile memory to maintain copies of usage total values, while concurrently storing such usage total values on a disk memory. If an attempt is made to substitute a different disk memory in the EPC, usage parameter values are updated thereon through use of values stored in the nonvolatile memory.

14 Claims, 3 Drawing Sheets

METHOD AND APPARATUS FOR METERING PRINTER/COPIER USAGE

FIELD OF THE INVENTION

This invention relates to methods and devices for measurement of printer and copier usage and, more particularly, to a method and apparatus which provides an accurate metering of media sheet output, toner usage and scanner usage of a printer/copier.

BACKGROUND OF THE INVENTION

Currently, many contracts for maintenance of printers/copiers are dependent upon an accurate measurement of the use of the respective printer/copier covered by the contract. Further, equipment leases for printer/copiers often base their charges upon quantities of media that are output. To meter such usage and output, printers/copiers are provided with counters which generally count only media sheet picks from an input media bin. Such a count neither considers nor corrects the count value in the event of a paper jam or other malfunction which prevents a picked sheet from reaching an output bin.

Many printers/copiers have an ability to accommodate multiple sizes of media sheets, e.g., 8 ½×11, A-4, 8 ½×14, etc. Each such media sheet size can accommodate either more or less printing, depending upon relative sheet size. Unless the size of the media sheet is taken into account in a measurement of printer/copier usage, an accurate usage measure is difficult, if not impossible, to acquire.

Multi-functional printers are provided with a scanner which enables a document to be scanned into memory and for one or more copies to be made from the data derived from such scan action. Since the scanner is an expensive portion of the printer/copier, it is important to have a measure of its usage. A mere count of output pages produced by the printer/copier will not provide such a measure due to the fact that once a document is scanned, multiple copies can be made, simply by accessing the document data maintained in memory. Further, some copiers may be heavily utilized for single copy actions thereby exhibiting an almost one-for-one scan action per output sheet, while others may be heavily utilized for making multiple copies wherein the number of scans are much fewer than the number of output sheets.

Accordingly, there is a need to accurately measure the number of media sheets output from a printer/copier; to measure the number of operations of a document scanner included in the printer/copier; to measure the amount of toner used; and to provide a facility to enable the manufacturer or lessor to adjust a usage metering value in a manner which accurately measures printer/copier usage and, in addition, takes into account the aforesaid measurements.

There is a further need to assure that a level of security is maintained so that the usage count and/or metering action cannot be readily altered or sabotaged by a user. Further, if such alteration is attempted, a facility for correcting the alteration, while allowing continued machine usage is preferred.

Accordingly, it is an object of this invention to provide an improved method and apparatus for metering usage of a printer/copier.

It is another object of this invention to provide a metering method which enables accurate analysis of toner usage to be obtained.

It is yet another object of this invention to provide a method for metering printer/copier usage which provides an accurate output count of media sheets fed to an output bin, rather than media sheets picked from an input bin.

It is yet a further object of this invention to provide an improved metering facility for a printer/copier which measures scanner usage.

It is still a further object of this invention to provide a method for securing usage metering data in such a manner as to counteract attempted tampering.

SUMMARY OF THE INVENTION

The invention accurately meters usage of an electrophotographic printer/copier (EPC) by counting the number of pages that are ejected to an output bin of the EPC and incrementing a user charge value accordingly. Further, the invention determines a toner parameter value that is related to an amount of toner used on each page and bases the user charge value, at least in part, on such toner parameter value. The toner parameter value is preferably determined by counting a number of pixels that are imaged on a page. The invention further utilizes a non-volatile memory to maintain copies of usage total values, while concurrently storing such usage total values on a disk memory. If an attempt is made to substitute a different disk memory in the EPC, usage parameter values are updated thereon through use of values stored in the nonvolatile memory.

DETAILED DESCRIPTION OF THE INVENTION

Figure 1:
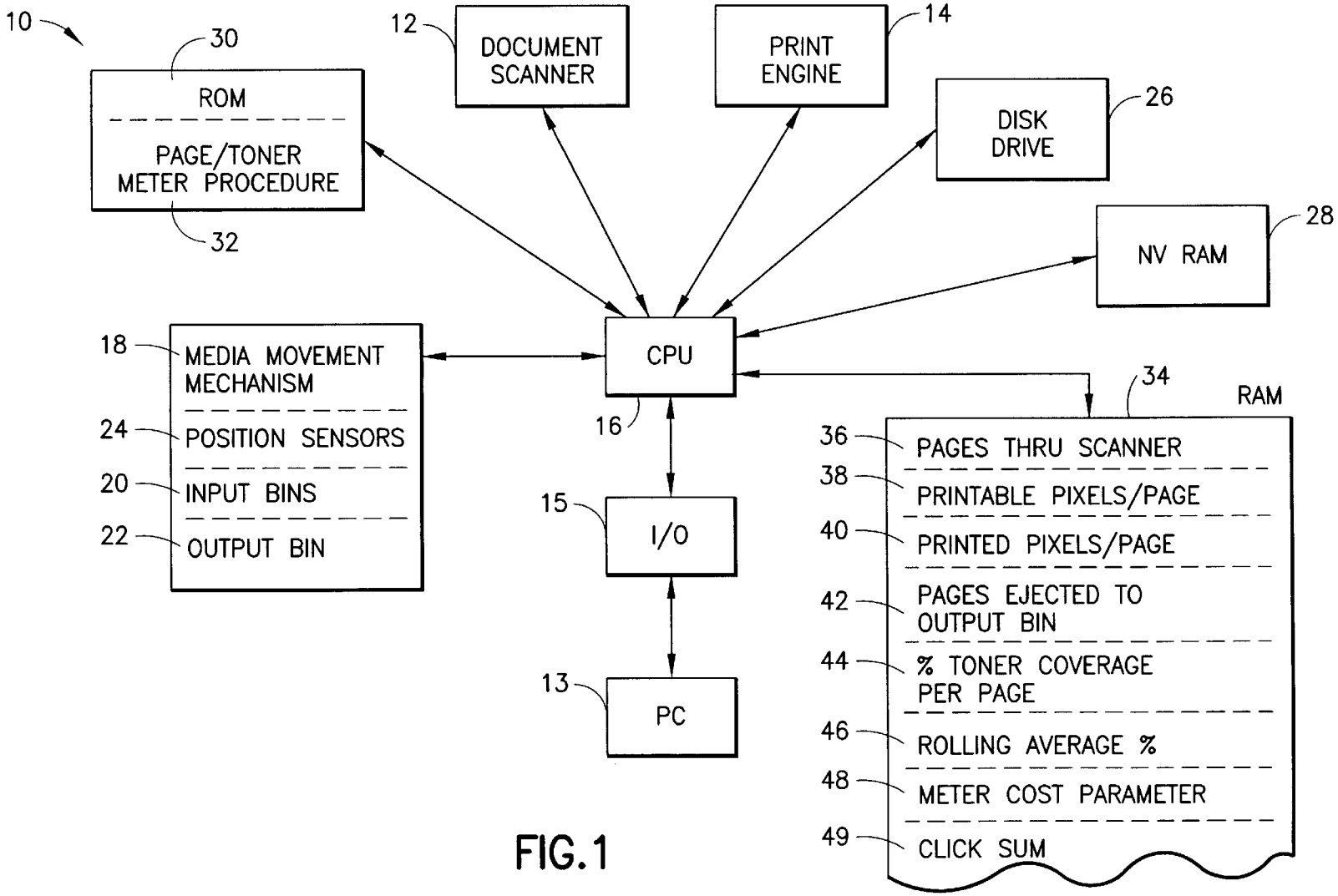
FIG. 1 is a high level block diagram of an EPC incorporating the invention.

Referring to FIG. 1, an EPC 10 incorporates a document scanner 12, a print engine 14 and a central processing unit 16 which controls the overall operation of EPC 10. A media movement mechanism 18 provides a facility for moving media sheets from an input bin 20 to an output bin 22. A plurality of position sensors 24 are positioned along the media movement path to indicate the progress a media sheet moving through EPC 10. In particular, one position sensor 24 is present at each input bin to provide an indication of the picking of a page from a respective bin. A further position sensor 24 is positioned at output bin 22 to indicate the successful ejection of a page thereto.

A disk drive 26 is incorporated into EPC 10 and provides a facility for storing metered usage data, as such data is accumulated. A nonvolatile random access memory (NVRAM) 28 provides persistent storage for certain metering values and further provides a facility for enabling recovery of such metering values upon either failure of disk drive 26 or a replacement thereof by a user.

A read-only memory (ROM) 30 incorporates a page/toner metering procedure 32 which provides, in conjunction with CPU 16, overall control of the metering action within EPC 10. A random access memory (RAM) 34 provides storage for a number of measurement values and parameters that are utilized during the operation of page/toner metering procedure 32. In particular, RAM 34 includes a value 36 that is equal to the number of pages of each page size scanned by document scanner 12; a value 38 corresponding to the total number of printable pixels on a page; and a value 40 corresponding to the actual number of printed pixels on a page.

Value 38 is determined when a position sensor 24 at an input bin 20 (assuming plural bins for holding different size pages) indicates the picking of a page therefrom. That action causes CPU 16 to insert a value equal to the total number of printable pixels on the particular size picked page into region 40 of RAM 34. That value is a constant for each size page and is stored in page/toner metering procedure 32.

The number of printed pixels per page is determined from a count of image pixels that are sent by CPU 16 to print engine 14. More particularly, each pixel value that is sent to print engine 14 is indicative of a spot which will have ink/toner applied. Each such pixel value is counted and the count is used to provide an indication of the amount of ink/toner used for the respective page. Upon completion of the transmission of pixel data for a page to print engine 14, CPU 16 writes into region 40 the total number of printed pixels on the page.

RAM 34 further includes a further value 42 equal to a count of the number of pages of each size ejected to output bin 22. Region 44 of RAM 34 includes a value equal to a percent of toner coverage per page. That percent is calculated from the ratio of the number of printable pixels per page (value 38) to the number of printed pixels on the page (value 40). Region 46 includes a rolling average of the calculated percentage values.

A further value stored in memory 34 is a meter cost parameter 48 that is settable by a user input. More particularly, meter cost parameter 48 is a value which takes into consideration a plurality of the factors that are measured during the operation page/toner metering procedure 32. For instance, meter cost parameter 48 utilizes as input values, (i) the number of pages ejected to output bin 42, (ii) the percent toner coverage 44 on the page, and (iii) a value determined from the number of pages 36 that are scanned. Page/toner procedure 32 correlates those values to a "click" parameter for each page. More particularly, for each page that is ejected to the output bin, a click value is calculated based on meter cost parameters 48 and is added to a rolling "click sum" 49. Rolling click sum 49 is then equated, by page/toner metering procedure 32, to a cents value per output page which is to be charged to the customer.

As will be hereafter understood, click value rolling sum 49 (and other values) are periodically written to disk drive 26 for later access by page/toner meter procedure 32. Further, a certain subset of those values is written to NVRAM 28 so as to enable those values to be recovered in the event of a failure or replacement of disk drive 26.

In addition to receiving documents from document scanner 12, EPC 10 may also receive documents to be printed from a PC 13 that connects through an input/output (I/O) interface 15 to CPU 16. It is to be further noted that access may be had to EPC 10 via I/O 15 from other sources than PC 13. For instance, a remotely operated computer (not shown) can access EPC 10, via an Internet connection, to retrieve various user charges which have been accumulated.

Figure 2A:
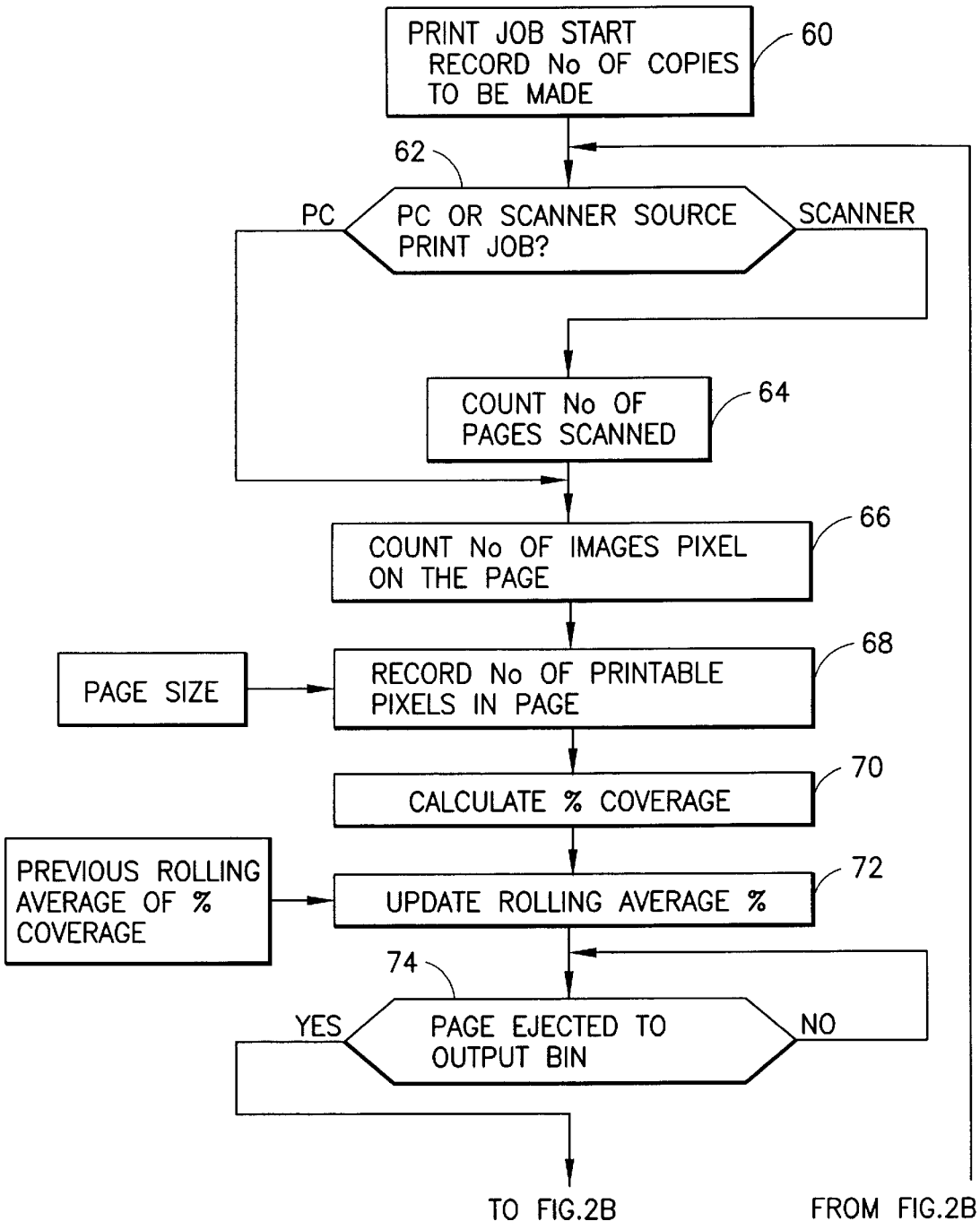
FIGS. 2A and 2B illustrate a logic flow diagram describing the operation of the system shown in FIG. 1.
Figure 2B:
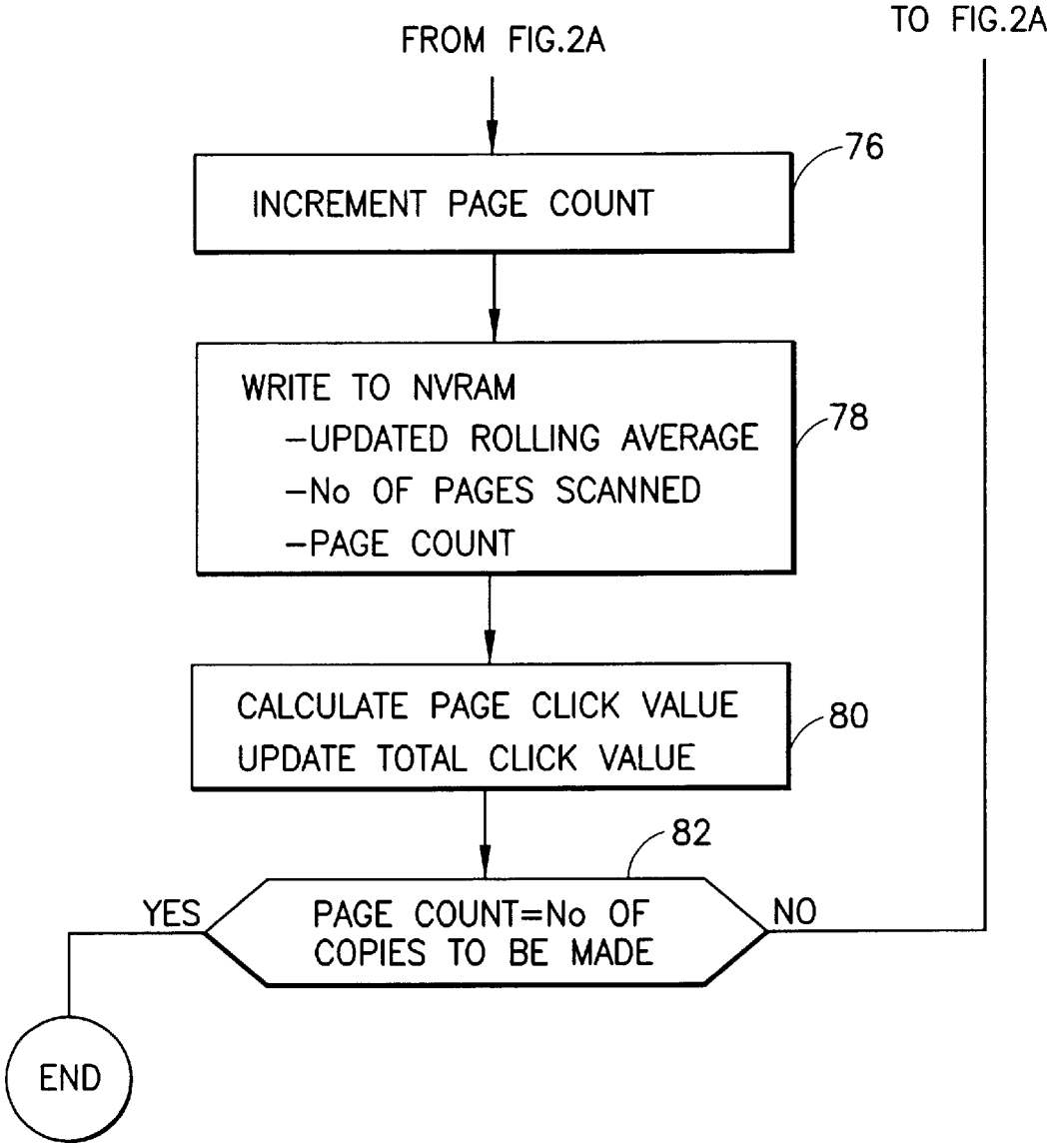

Turning now to FIGS. 2A and 2B, the method of the invention will be further described. Initially, as shown in step 60, a print job is initiated and the user inputs the number of copies to be made. Thereafter, it is determined whether the print job is from a PC source, requiring no use of document scanner 12, or is to be input from document scanner 12 (step 62). If the document is to be input via scanner 12, a count is recorded in region 36 of RAM 34 of the number of pages (by page size) that are input from document scanner 12 (step 64).

Thereafter, page/toner metering procedure 32 moves to step 66 which is common to documents input from either a PC source or from document scanner 12. In step 66, the number of imaged pixels on a page 40 are recorded from a count of ON pixels fed to print engine 14 from CPU 16. In addition (step 68), the number of printable pixels on the page 38 are recorded, based upon a particular bin from which the media sheet is picked (each bin holding a different page size). That value is a constant and is recovered from ROM 32 by CPU 16, upon receiving an indication of the particular bin from which the page has been accessed.

The values recorded at steps 66 and 68 enable a percentage coverage 44 of the page by ink/toner to be recorded (step 70). Thereafter (step 72), rolling average percent 46 is updated, using the calculated percent coverage 44 determined at step 70 and a previous rolling average of percent coverage determined for a prior page. Note that the rolling average can be weighted in accord with the size of the page or envelope.

Until a media page has been determined as being ejected to the output bin (step 74), no further action is taken. However, once the media page is ejected to the output bin, a page count value for the respective page size is incremented and recorded (step 76). Thereafter, certain of the metered values that have been recorded in RAM 34 are written to both disk drive 26 and NVRAM 28. It is preferred that each metered or calculated value, as it is calculated, is immediately stored to disk drive 26 so as to assure its subsequent availability.

With respect NVRAM 28, it is preferred that only the results of certain calculations are stored therein so as to assure an availability of such values, upon a requirement to reconstruct such data. As shown in step 74, updated rolling average percent 46, the number of pages scanned 36, and an ejected page count 42 are recorded to NVRAM 28 (step 78). In addition, a calculation is performed, based upon the aforesaid values, that determines a number of "clicks" to be added to rolling click sum 49. Rolling click sum 49 can thereafter be mapped to a charge to the user through use of a conversion parameter that is input by a manufacturer/lessor/third-party supplier.

Finally, if the page count does not equal the number of copies to be made, the procedure recycles and repeats for each page being processed through EPC 10.

Upon power-up, EPC 10 compares the metered values stored on disk drive 26 and NVRAM 28. If the values are inconsistent, the values from NVRAM 28 are written to disk 26 and are thereafter utilized as the datums from which user charges are calculated. As indicated above, the user charge per page may be configured to take into account not only the number of pages output to an output bin, but also the percent coverage of the page by toner/ink and the number of pages scanned. Accordingly, the ultimate user charge is dependent upon usage of the various elements of the EPC.

Further, by assuring that the charge is not incremented for pages that do not reach the output bin, the user is not charged for unsuccessful print/copy actions.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method for accurately metering usage of an electrophotographic printer/copier (EPC), comprising the steps of:

a) determining a toner parameter value related to an amount of toner used on each page imaged in said EPC, wherein said toner parameter value is based, at least in part, on a count of a total number of pixels that are imaged on a page;

b) counting a number of pages ejected to an output bin of said EPC;

c) incrementing a user charge value for a page only if said page is ejected to said output bin in step b;

d) accumulating a total user charge value based on a determined result from step c;

e) writing said total user charge value to a first nonvolatile memory;

f) writing said total user charge value to second nonvolatile memory in said EPC; and g) upon power-up of said EPC, comparing a total user charge value in said second nonvolatile memory and a total user charge value from said first nonvolatile memory and if there is a difference in values therebetween, commencing a remedial action.

2. The method as recited in claim 1, wherein said user charge value for page is based, at least in part, on said toner parameter value for said page.

3. The method as recited in claim 2, comprising the further step of:

d) counting a number of pages of each page size output from a page scanner included in said EPC; and wherein said user charge value is further based, at least in part, on said number of pages of each page size scanned, per page that is output to said output bin.

4. The method as recited in claim 1, wherein step a further determines said user charge value based upon a page size parameter which is related to a size of a page being processed.

5. The method as recited in claim 4, wherein said page size parameter further indicates a total number of pixels that may be imaged on a particular page size.

6. The method as recited in claim 1, wherein said user charge value is based, at least in part, on whether a page is printed on one or both sides.

7. The method as recited in claim 1, wherein said remedial action comprises the step of:

h) writing said total user charge value from said nonvolatile memory to said disk memory.

8. A memory media for controlling an electrophotographic printer/copier (EPC) to meter its usage, comprising:

a) means for controlling said EPC to determine a toner parameter value related to an amount of toner used on each page imaged in said EPC, wherein said toner parameter value is determined, at least in part, by counting a total number of pixels that are imaged on a page;

b) means for controlling said EPC to count a number of pages ejected by an ejection means to an output bin of said EPC;

c) means for controlling said EPC to increment a user charge value for a page only if said page is ejected to said output bin by said ejection means.

d) means for controlling said EPC to accumulate a total user charge value based on a determined result from means c;

e) means for controlling said EPC to write said total user charge value to a first nonvolatile memory;

f) means for controlling said EPC to write said total user charge value to a second nonvolatile memory in said EPC; and g) means for controlling said EPC, upon power-up, to compare a total user charge value in said second nonvolatile memory and a total user charge value from said first nonvolatile memory and if there is a difference in values therebetween, to commence a remedial action.

9. The memory media as recited in claim 8, wherein said user charge value for a page is based, at least in part, on said toner parameter value for said page.

10. The memory media as recited in claim 9, wherein said user charge value is based, at least in part, on whether a page is printed on one or both sides.

11. The memory media as recited in claim 9, further comprising:

d) means for controlling said EPC to count a number of pages output from a page scanner included in said EPC; and wherein said user charge value is further based, at least in part, on a number of pages scanned per page that is output to said output bin.

12. The memory media as recited in claim 8, wherein toner parameter value determining means controls said EPC to further determine said toner parameter value based upon a page size parameter which is related to a size of a page being processed.

13. The memory media as recited in claim 12, wherein said page size parameter indicates a total number of pixels that may be imaged an a particular page size.

14. The memory media as recited in claim 8, further comprising:

h) means for controlling said EPC to accomplish said remedial action by writing said total user charge value from said nonvolatile memory to said disk memory.

* * * * *